US012427436B1

(12) United States Patent
Reiner

(10) Patent No.: US 12,427,436 B1
(45) Date of Patent: Sep. 30, 2025

(54) WING ASSEMBLY AND A DEVICE FOR COUPLING TO A TOY

(71) Applicant: Russell Reiner, Boynton Beach, FL (US)

(72) Inventor: Russell Reiner, Boynton Beach, FL (US)

( * ) Notice: Subject to any disclaimer, the term of this patent is extended or adjusted under 35 U.S.C. 154(b) by 287 days.

(21) Appl. No.: 18/133,564

(22) Filed: Apr. 12, 2023

Related U.S. Application Data

(60) Provisional application No. 63/329,948, filed on Apr. 12, 2022.

(51) Int. Cl.

| | |
|---|---|
| ***A63H 27/28*** | (2006.01) |
| ***A63H 7/00*** | (2006.01) |
| ***A63H 13/02*** | (2006.01) |
| ***A63H 27/00*** | (2006.01) |
| ***A63H 29/22*** | (2006.01) |

(52) U.S. Cl.
CPC ..... *A63H 7/00* (2013.01); *A63H 13/02* (2013.01); *A63H 27/008* (2013.01); *A63H 29/22* (2013.01)

(58) Field of Classification Search
CPC ..... A63H 27/008; A63H 27/02; A63H 27/04; A63H 33/26
See application file for complete search history.

(56) References Cited

U.S. PATENT DOCUMENTS

| | | | | |
|---|---|---|---|---|
| 4,729,748 | A * | 3/1988 | Van Ruymbeke | A63H 27/00 446/376 |
| 5,163,861 | A * | 11/1992 | Van Ruymbeke | A63H 27/008 244/22 |
| 6,544,092 | B1 * | 4/2003 | Tomas | A63H 27/008 446/486 |
| 6,550,716 | B1 * | 4/2003 | Kim | B64U 10/40 244/22 |
| 6,632,119 | B2 * | 10/2003 | Chernek | A63H 29/18 244/72 |
| 6,769,949 | B2 * | 8/2004 | Kim | A63H 27/008 244/22 |
| 9,216,823 | B2 * | 12/2015 | Matte | A63H 27/008 |
| 2001/0049249 | A1 * | 12/2001 | Tachau | A63H 27/02 446/397 |
| 2002/0173217 | A1 * | 11/2002 | Kinkade | A63H 27/008 446/35 |

* cited by examiner

*Primary Examiner* — John A Ricci
(74) *Attorney, Agent, or Firm* — John Rizvi; John Rizvi, P.A.—The Patent Professor®

(57) ABSTRACT

A device configured to be detachably coupled to a toy is described. The device comprises a housing and a wing assembly coupled to the housing. The wing assembly comprises at least one wing configured to rotate about a rotational axis in a flapping motion, and a gear assembly configured to cause rotation of the at least one wing. The device further comprises at least one coupling means configured to engage with a magnetic strip of the toy, thereby facilitating a detachable coupling of the device with the toy.

19 Claims, 12 Drawing Sheets

WING ASSEMBLY AND A DEVICE FOR COUPLING TO A TOY

CROSS-REFERENCE TO RELATED APPLICATIONS

This application claims the benefit of U.S. Provisional Patent Application Ser. No. 63/329,948, filed on Apr. 12, 2022, which is incorporated herein in its entirety.

FIELD OF THE INVENTION

The present invention relates generally to devices and toys provided with wings, and more particularly to a wing assembly and a device comprising the wing assembly that can be coupled to various toys.

BACKGROUND OF THE INVENTION

Conventionally, toys with wings are available in the market. The toys have wings integrated into the body of toys in a permanent manner. The toys are used by a child for playing, however, the wings are permanently integrated into the toy and cannot be removed from the toy or used with another toy. A child desiring to play with multiple toys having wings will require buying multiple such toys from the market. Many times, buying multiple toys of the same nature is considered a waste of money by the parents or guardians of the child.

Further, toys with wings are intended to be flown by a user, for instance, by control of a remote. Such toys are not only expensive but also not convenient for small children, for example, toddlers. Such toys require attention and care to carry out the flight of the toy which may not be possible for a small child. Thus, the parents or guardians of the child usually control the flight of the toy while the child merely watches the toy, reducing the experience of playing with the toy. Moreover, small children may require a toy with only an effect of flying while the toy remains in their hand.

Accordingly, there is an established need for a solution to the problems mentioned above. For instance, there is an established need for a wing assembly and a device that can be detachably coupled to a variety of toys. Further, there is an established need for a wing assembly and a device that can be conveniently detached from one toy and inserted into another toy. Further, there is an established need for a wing assembly and a device that provides a toy with a flying effect without causing the toy to take flight.

SUMMARY OF THE INVENTION

The present invention relates to a device configured to be detachably coupled to a toy. The device comprises a housing and a wing assembly coupled to the housing. The wing assembly comprises at least one wing configured to rotate about a rotational axis in a flapping motion, and a gear assembly configured to cause rotation of the at least one wing. The device further comprises at least one coupling means configured to engage with a magnetic strip of the toy, thereby facilitating a detachable coupling of the device with the toy.

In an aspect, the coupling means is a magnet.

In an aspect, the rotation of the gear assembly comprises alternate and cyclic rotation in opposite directions, thereby causing the flapping motion of the at least one wing.

In an aspect, the wing assembly comprises wing frames, the wing frames being connected to the gear assembly such that rotation of the gear assembly causes rotation of the wing frames.

In an aspect, the wing assembly further comprises frame extensions configured to connect the at least one wing to the wing frames, the frame extensions being connected to the wing frames such that rotation of the wing frames causes rotation of the frame extensions, and thereby, rotation of the at least one wing.

In an aspect, the device is devoid of flying capabilities.

In an aspect, the coupling means is provided at a bottom surface of the housing and the wing assembly is coupled to a top surface of the housing, the top surface being opposite to the bottom surface.

In an aspect, the device is configured to be at least partially inserted into a receiving chamber of the toy.

In an aspect, the wing assembly further comprises a battery and a motor in electrical communication with the battery.

In an aspect, the battery is rechargeable.

In an aspect, the gear assembly is coupled to the motor such that activation of the motor causes rotation of the gear assembly.

In an aspect, the device comprises a button configured to control activation of the motor.

In an aspect, the present invention is directed to a wing assembly comprising at least one wing configured to rotate about a rotational axis in a flapping motion, the wing assembly further comprising at least one wing frame, at least one frame extension, a gear assembly, a motor, and a battery to facilitate rotation of the at least one wing.

In as aspect, the present invention is directed towards a toy comprising a receiving chamber, the receiving chamber being configured to receive the device according to any of the aspects described above.

These and other objects, features, and advantages of the present invention will become more readily apparent from the attached drawings and the detailed description of the embodiments and examples, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
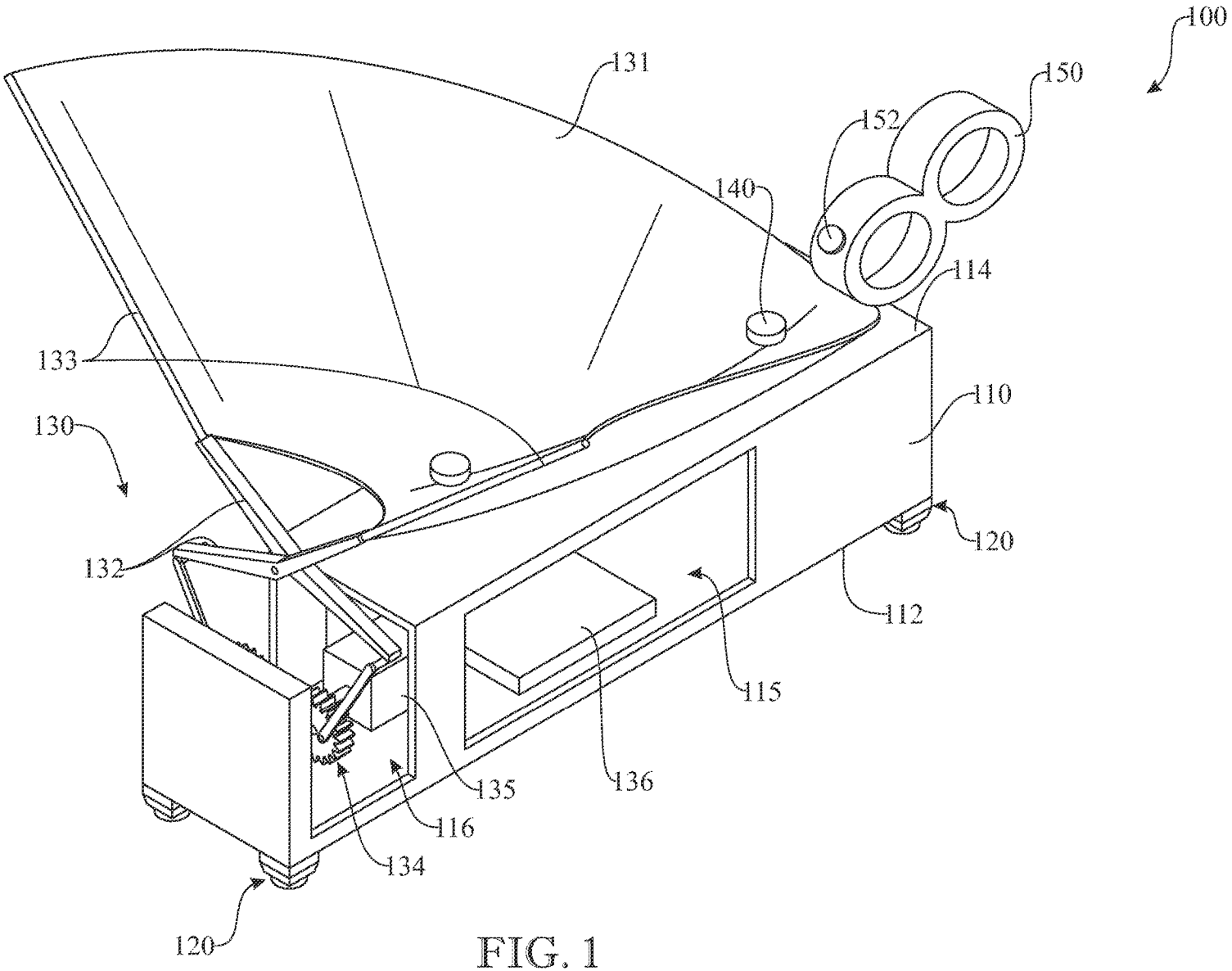
FIG. 1 illustrates a side perspective view of a winged device, in accordance with one embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other embodiments. All of the embodiments described below are exemplary embodiments provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in the drawings. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

In the following description, certain specific details are set forth in order to provide a thorough understanding of various disclosed embodiments. However, one skilled in the relevant art will recognize that embodiments may be practiced without one or more of these specific details, or with other methods, components, materials, and the like. In other instances, well-known elements associated with wing assembly, winged devices, and toys have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is, as "including, but not limited to."

As used in this specification and the appended claims, the singular forms "a," "an," and "the" include plural referents unless the content clearly dictates otherwise, and the vice versa. It should also be noted that the term "or" is generally employed in its broadest sense, that is, as meaning "and/or" unless the content clearly dictates otherwise.

The headings and Abstract of the Disclosure provided herein are for convenience only and do not interpret the scope or meaning of the embodiments.

As used herein, the term "electronic device" includes but is not limited to smart phones, tablets, laptops, desktops, or smart watches.

Shown throughout the drawings, the present invention is directed toward a wing assembly and a winged device comprising the wing assembly, the winged device being configured to be detachably coupled to a variety of toys. The child, or a caretaker, may couple the winged device to a particular toy so as to allow a child to play with the toy. The winged device provides the toy with a flying effect, however, without causing the toy to fly on its own. The child can thus hold the toy in the hand and play with the toy. The winged device can further be easily detached from the toy and coupled to another toy, for instance, when the child desires to play with another toy. Thus, the present invention provides an easy to use winged device that can be removably attached to a variety of toys conveniently.

Reference is initially made to FIG. 1 that illustrates a perspective views of winged device 100 configured to be coupled with a toy (not shown in FIG. 1). The winged device 100 is configured to be detachably coupled to a toy, in that, the winged device 100 may be coupled to a first toy, detached from the first toy, and then coupled to a second toy different from the first toy. Accordingly, the winged device 100 is configured to be coupled to various toys on the basis of current requirements of a user.

The term 'toy' as used in the present specification and claims is intended to refer to various types of objects that are used by a child for playing. Some non-limiting examples of toys include miniature replicas and models of planes, birds, insects, fairies, vehicles, fictional characters, and the like. The term 'user' as used in the present specification and claims refers to a child or a caretaker/guardian of a child.

The winged device 100 comprises a housing 110 that functions as a support for various components forming the winged device 100. The housing 110 may be of any predetermined dimensions so as to couple with one or more different toys. The housing 110 may be of any predetermined shape so as to couple with one or more different toys. In the illustrated embodiment, the housing 110 has a cuboidal shape. In some embodiments, the housing 110 can be cylindrical, spherical, elliptical, cubical, or like in shape.

The housing 110 comprises a bottom surface 112 and a top surface 114. The bottom surface of the housing 110 comprises coupling means 120 that enable the housing 110, and thus the winged device 100, to be coupled to a toy. In some embodiments, the coupling means 120 may be integrally formed with the bottom surface 112 of the housing 110. In some embodiments, the coupling means 120 may be detachably mounted to the bottom surface 112 of the housing 110.

In an embodiment, the coupling means 120 is a magnet, allowing the housing 110, and thus the device 100, to be coupled to a toy by magnetic coupling. In some embodiments, the magnet may be a permanent magnet. In some embodiments, the magnet may be an electromagnet. It is appreciated that the toy to which the winged device 100 is to be coupled comprises corresponding magnetic component to interact with the magnet of the winged device 100. For instance, the winged device 100 may comprise permanent magnet while the toy may comprise magnetic elements that are attracted to the permanent magnet.

In the illustrated embodiment, the winged device 100 comprises at least four coupling means 120 in the form of magnets (of which only three are visible in FIG. 1) being provided at four corners of the bottom surface 112 of the housing 110. It is appreciated that coupling means 120 may also be provided at central portions of the bottom surface 112 or at any other portions of the bottom surface 112 so as to facilitate a proper coupling of the housing 110 with a toy.

The winged device 100 comprises a wing assembly 130 arranged at least partially within the housing 110. The wing assembly 130 may further be attached to the top surface 114 of the housing 110 to securely hold the wing assembly 130 in place. The wing assembly 130 comprises at least one wing 131 which is configured to rotate about an axis of rotation at least partially in a flapping motion, as will be described in detail further below. It is appreciated that the at least one wing 131 may be formed of a flexible and light material to facilitate the flapping motion.

The wing assembly 130 comprises wing frames 132 and frame extensions 133 that are configured to hold the at least one wing 131 and facilitate the flapping motion of the at least one wing 131. The wing assembly 130 comprises a gear assembly 134, a motor 135, and a battery 136 that facilitate the flapping motion of the at least one wing 131. The wing assembly 130 will further be described in detailed with reference to FIG. 3.

Figure 2:
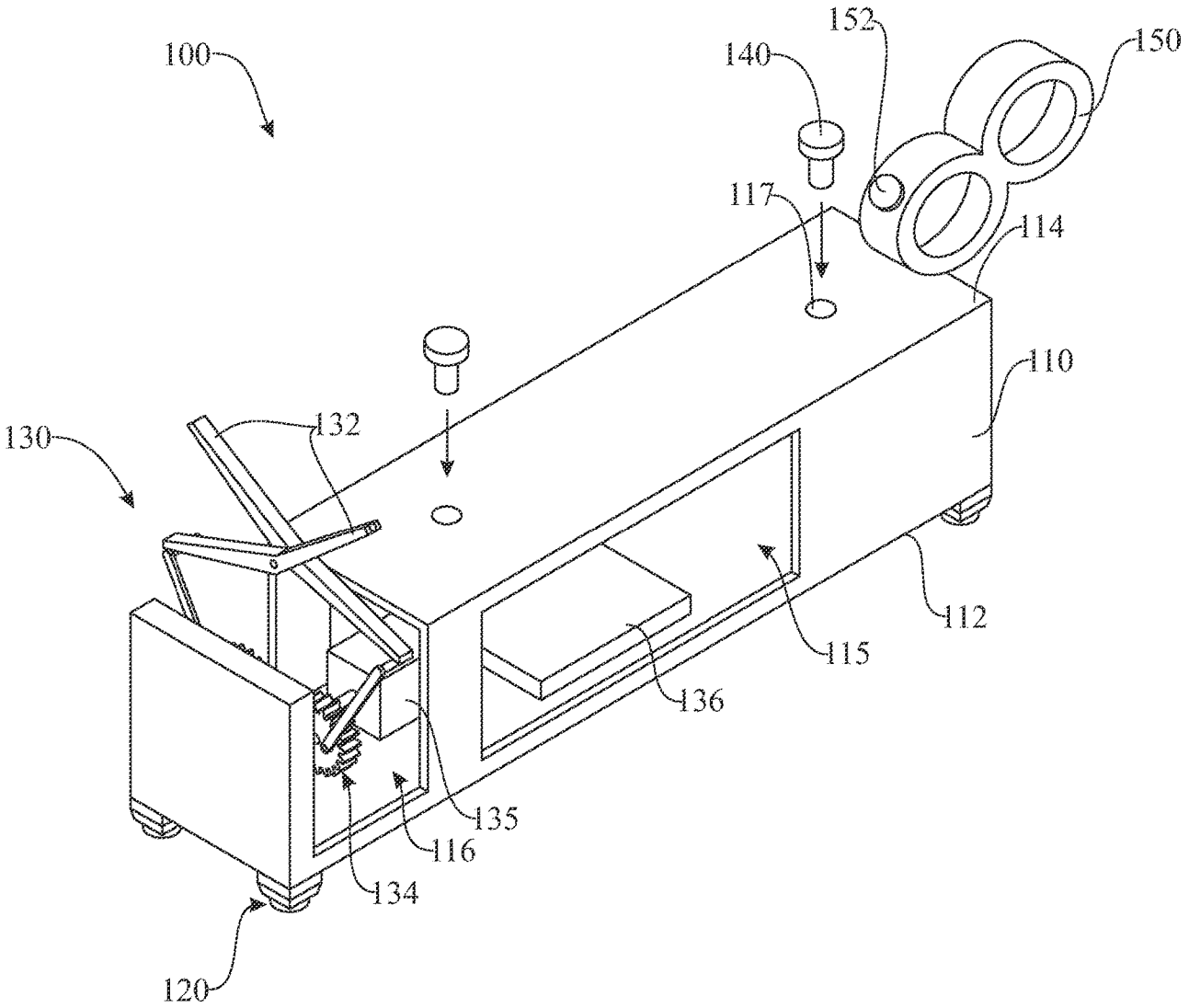
FIG. 2 illustrates a side perspective view of the winged device, with the wing removed and pegs being inserted into the housing, in accordance with one embodiment of the present invention.

The winged device 100 further comprises one or more pegs 140 being configured to couple the at least one wing 131 of the wing assembly 130 to the housing 110, in particular, to the top surface 114 of the housing 110. FIG. 2 illustrates the winged device 100 with the at least one wing 131 and frame extensions 133 being removed for illustration purposes. As can be seen in FIG. 2, the housing 110 comprises holes 117 corresponding to the one or more pegs 140, the holes 117 being formed at the top surface 114 of the housing 110. The holes 117 are configured to allow the corresponding pegs 140 to be inserted so as to form a secure coupling therewith.

In some embodiments, the housing 110 may comprise an opening 115 to assist in assembling various components of the wing assembly 130 as well as maintenance and repair of the various components of the wing assembly 130. In some embodiments, at least the battery 136 and the motor 135 are disposed within the housing 110 so as to be accessible from the opening 115. In some embodiments, the housing 110 may fully enclose the battery 136 and the motor 135, i.e., the housing 110 may be without the opening 115.

In some embodiments, the housing 110 may comprise an open area 116 for supporting and holding at least the gear assembly 134 and wing frames 132 of the wing assembly 130, the open area 116 being configured to allow unobstructed movement of the gear assembly 134 and the wing frames 132 during the flapping motion of the at least one wing 131.

As seen in FIGS. 1-2, the winged device 100 comprises a button mount 150 coupled to the housing 110. In the illustrated embodiment, the button mount 150 is mounted at a rear portion of the housing 110. The button mount 150 comprises a button 152 that enables a user to control the operation of the wing assembly 130. For instance, the button 152 may be pressed by a user to initiate operation of the wing assembly 130 and to stop operation of the wing assembly 130. The operation of the wing assembly will be described in detail with reference to FIGS. 4-6.

It is appreciated that the button mount 150 can be mounted at any suitable location on the device 100 to increase the ease of access for the users. Further, it is appreciated that the button mount 150 may be designed so as to increase the aesthetic appearance of the winged device 100.

Figure 3:
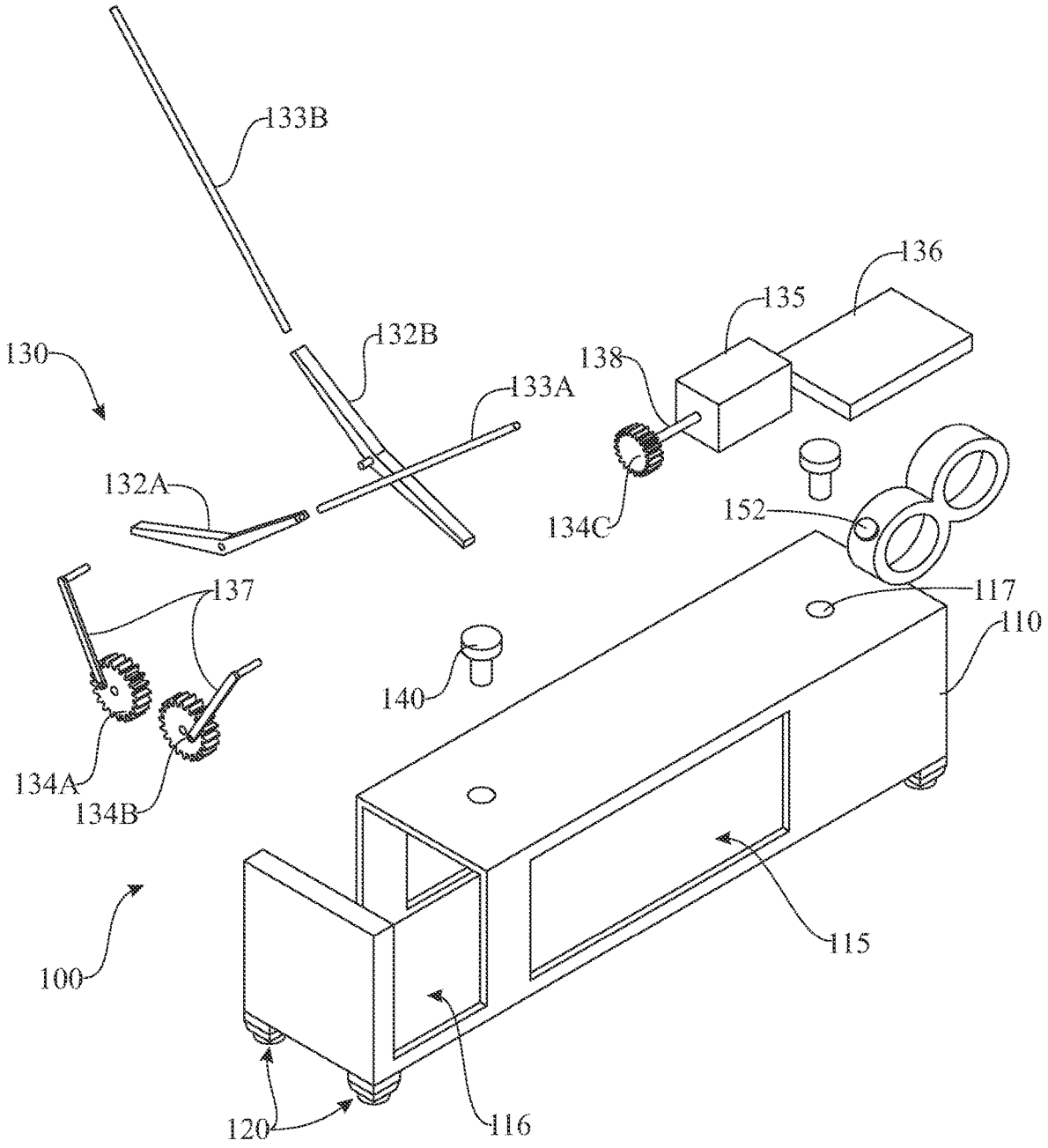
FIG. 3 illustrates an exploded view of the wing assembly of the winged device, in accordance with one embodiment of the present invention.

Reference is now made to FIG. 3 which illustrates an exploded view of the wing assembly 130, with the at least one wing 131 removed for illustration purposes. The wing assembly 130 comprises a battery 136 configured to provide electric power for operation of the wing assembly 130. In some embodiments, the battery 136 is a rechargeable battery so that a user can easily recharge the battery 136 as and when required. The battery 136 is disposed within the housing 110. In some embodiments, the battery 136 is accessible via the opening 115 in the housing 110.

The battery 136 is operatively coupled to the motor 135 of the wing assembly 130. The motor 135 is disposed within the housing 110. In some embodiments, the motor 135 may be accessible via the opening 115 in the housing 110, such as for repair and/or maintenance purposes. The motor 135 is configured to rotate the gear assembly 134, and the wing frames 132, thereby causing the at least one wing 131 to rotate in a flapping motion.

The motor 135 is configured to be connected to the gear assembly 134. The gear assembly 134 may be disposed within the open area 116 of the housing 110. In the illustrated embodiment, the gear assembly 134 comprises a set of three gears 134A, 134B, 134C in engagement with each other. The third gear 134C is directly connected to the motor 135 by means of a stem 138. The third gear 134C is further in engagement with each of the first gear 134A and the second gear 134B. The engagement of the gears 134A, 134B, 134C may be achieved by the presence of grooves on the gear surfaces, as would be apparent to a person skilled in the art.

It is appreciated that at least the first and second gears 134A, 134B may be of equal dimensions such that the ratio of extent of rotation of the first and second gears 134A, 134B is 1:1. That is, a rotation of the third gear 134C by a predetermined extent causes the same extent of rotation of the first and second gears 134A, 134B, thus causing a synchronized rotation of the wing frames 132 and the at least one wing 131 attached thereto.

The first and second gears 134A, 134B are connected to the wing frames 132 by means of corresponding arms 137. The wing frames 132 comprises a first wing frame 132A and a second wing frame 132B. The first gear 134A is connected to the first wing frame 132A while the second gear 134B is connected to the second wing frame 132B. The rotation of the first and second gears 134A, 134B causes rotation of the first and second wing frames 132A, 132B. The first and second wing frames 132A, 132B may further be connected to each other at a common point, the common point lying on an axis of rotation of the first and second wing frames 132A, 132B as well as the at least one wing 131.

The wing assembly 130 further comprises frame extensions 133 connected to the wing frames 132. The frame extensions 133 comprises a first frame extension 133A configured to be attached to the first wing frame 132A and a second frame extension 133B configured to be attached to the second wing frame 132B. The frame extensions 133A, 133B allow secure coupling of the at least one wing 131 to the first and second wing frames 132A, 132B.

Figure 5:
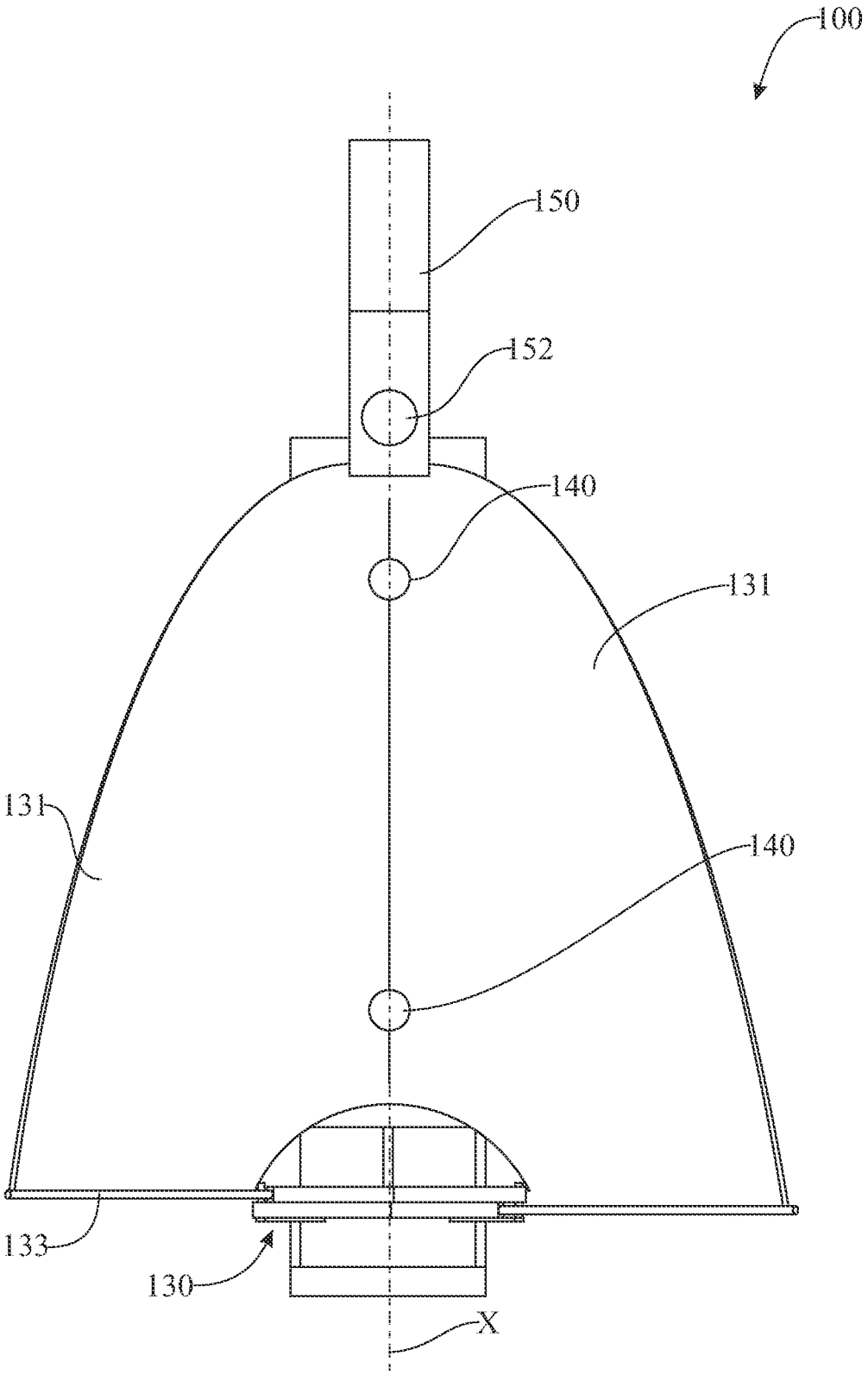
FIG. 5 illustrates a plan view of the winged device, in accordance with one embodiment of the present invention.

As can be seen in FIG. 5, which illustrates a plan view of the winged device 100, the at least one wing 131 is attached to the housing 110 by means of the pegs 140. The at least one wing 131 thus extends over both sides of the housing 110. On one side, the at least one wing 131 is coupled to the first frame extensions 133A and on the other side, the at least one wing 131 is coupled to the second frame extensions 133B.

It is appreciated that although the illustrated embodiment shows a single wing 131 extending over both sides of the housing 110, the wing assembly 130 may comprise two separate wings for coupling with the first and second frame extensions 133A, 133B.

Figure 4:
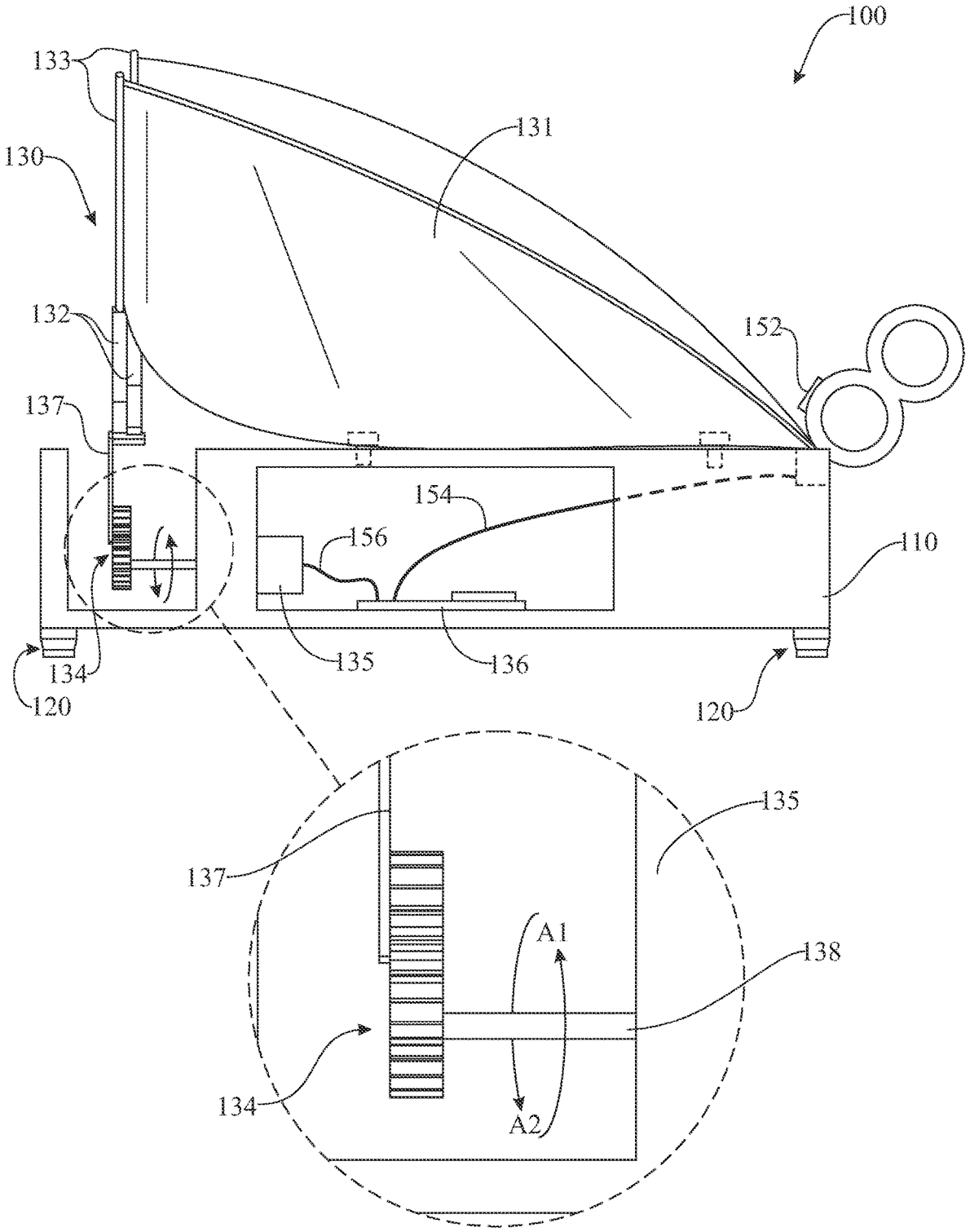
FIG. 4 illustrates side view of the winged device in operation, in accordance with one embodiment of the present invention.
Figure 6:
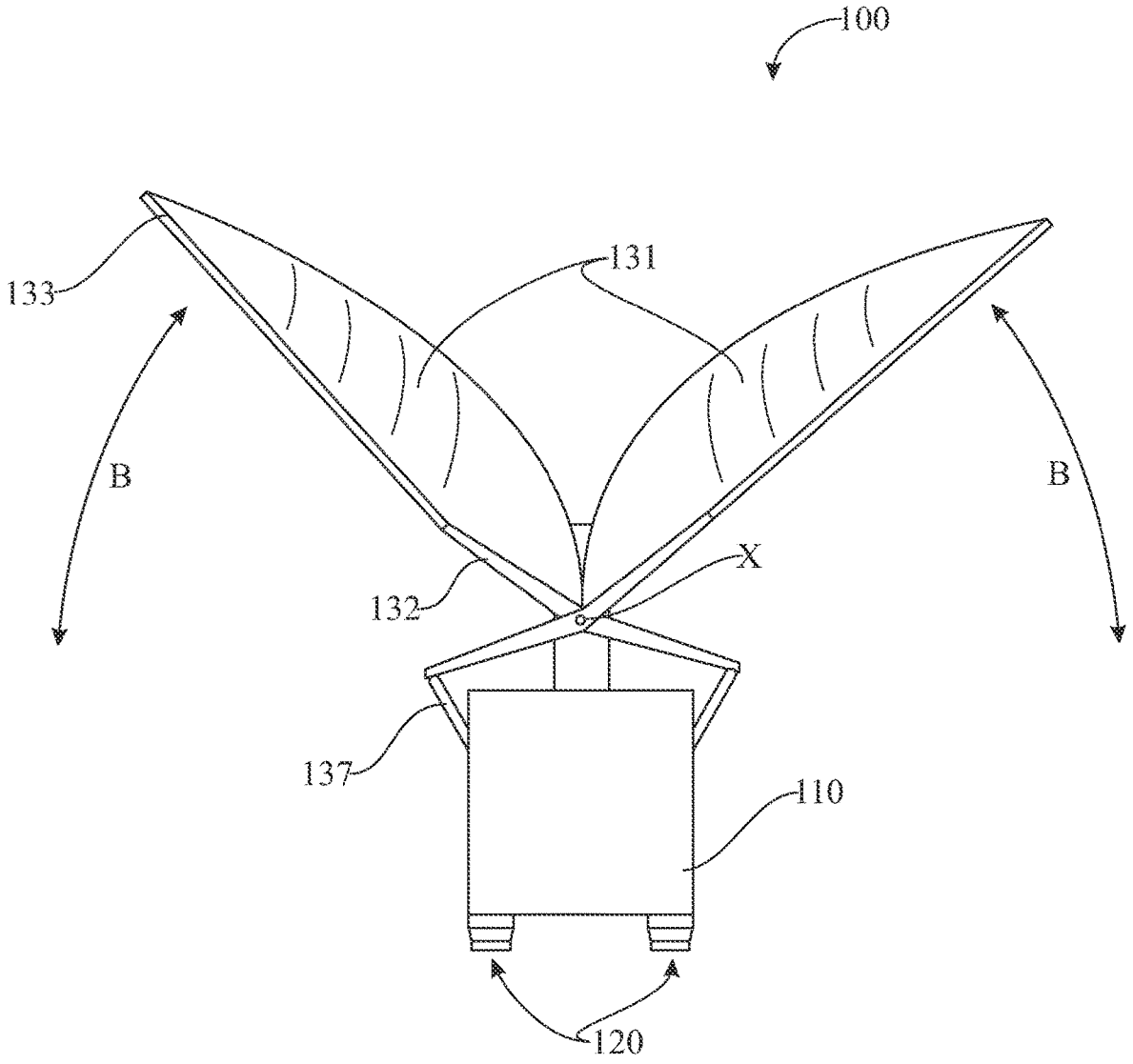
FIG. 6 illustrates a rear view of the winged device in operation, in accordance with one embodiment of the present invention.

Reference is now made to FIG. 4 and FIG. 6, in which, FIG. 4 illustrates a side view of the winged device 100 while FIG. 6 illustrates a rear view of the winged device 100. The button 152 is electrically connected to the battery 136 by means of a wire 154 and the battery 136 is electrically connected to the motor 135 by means of a wire 156. Upon activation of the button 152 by a user, such as by pressing the button 152, the motor 135 is activated.

The activation of the motor 135 causes rotation of the gear assembly 134, as depicted by arrows A1 and A2, in that, the motor rotates the third gear 134C by means of the stem 138, which further rotates the first and second gears 13A, 134B. The rotation of the gear assembly 134 is in an alternate clockwise and anti-clockwise manner, in that, the gear assembly 134 rotates first in the direction of arrow A1 and then in the direction of arrow A2. The alternate rotation of the gear assembly 134 continues as long as the motor 135 is kept activated, that is, the alternate rotation of the gear assembly is cyclic till the motor 135 is activated.

The rotation of the gear assembly 134 causes rotation of the wing frames 132 and the frame extensions 133, and thus the at least one wing 131 in a flapping motion. The at least one wing 131 and the wing frames 132 rotate about an axis of rotation X, the axis of rotation being shown in FIGS. 5 and 6. The rotation of the at least one wing 131, the frame extensions 133, and the wing frames 132 takes a path of an arc, i.e., the rotation is not a complete 360 degree rotation. This is because of the alternate rotation of the gear assembly 134 in the direction of arrows A1, A2.

As seen in FIG. 6, the at least one wing 131 along with the frame extensions 133 and the wing frames 132 rotate up and down about the axis X in a repeated manner as shown by arrows B, thereby providing the wing assembly 130 with the flapping motion. It is appreciated that the speed of flapping motion of the wing assembly 130 can be determined as per the requirements, and the motor 135 can be configured to rotate the gear assembly 134 at a corresponding speed.

Importantly, the flapping motion of the at least one wing 131 does not generate a flight of the winged device 100, i.e., the flapping motion of the at least one wing 131 does not cause the winged device to fly on its own. The winged device 100 is thus configured to be held in hand and played with by a child, the flapping motion of the at least one wing 131 providing a flying effect to the winged device 100 without causing the winged device 100, and the toy coupled to the winged device 100, to fly.

Figure 7:
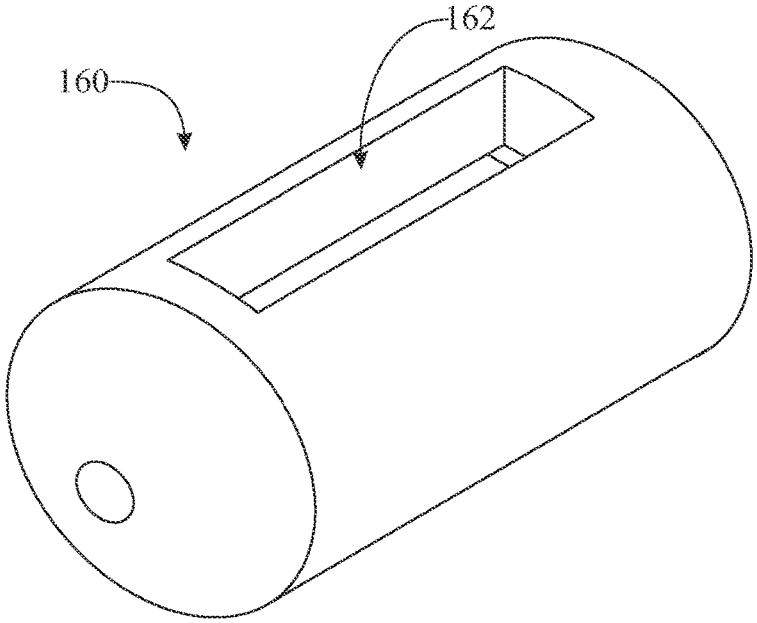
FIG. 7 illustrates a side perspective view of a toy, in accordance with one embodiment of the present invention.
Figure 8:
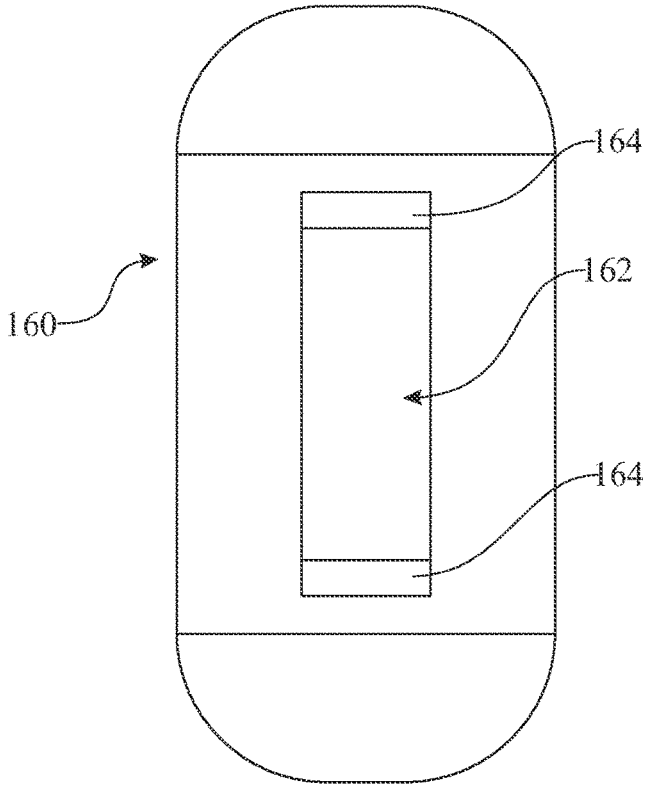
FIG. 8 illustrates a plan view of the toy of FIG. 7, in accordance with one embodiment of the present invention.

Reference is now made to FIGS. 7-8 which illustrate a toy 160 configured to couple with the winged device 100. FIG. 7 illustrates a perspective view of the toy 160 while FIG. 8 illustrates a plan view of the toy 160. The toy 160 is shown in a schematic manner and the toy 160 can take a form of common toys that are used by a child for playing. Some non-limiting examples of the toy 160 can be models of planes, birds, insects, fairies, vehicles, fictional characters, etc.

The toy 160 comprises a receiving chamber 162 configured to receive the winged device 100 therein. The receiving chamber 162 comprises magnetic strips 164 configured to interact with the coupling means 120 of the winged device 100. In some embodiments, the magnetic strips 164 may be formed of permanent magnets. In some embodiments, the magnetic strips 164 have a polarity to attract the coupling means 120 of the winged device 100. It is appreciated that the receiving chamber 162 may be dimensioned to snugly receive the winged device 100 therein.

Figure 9:
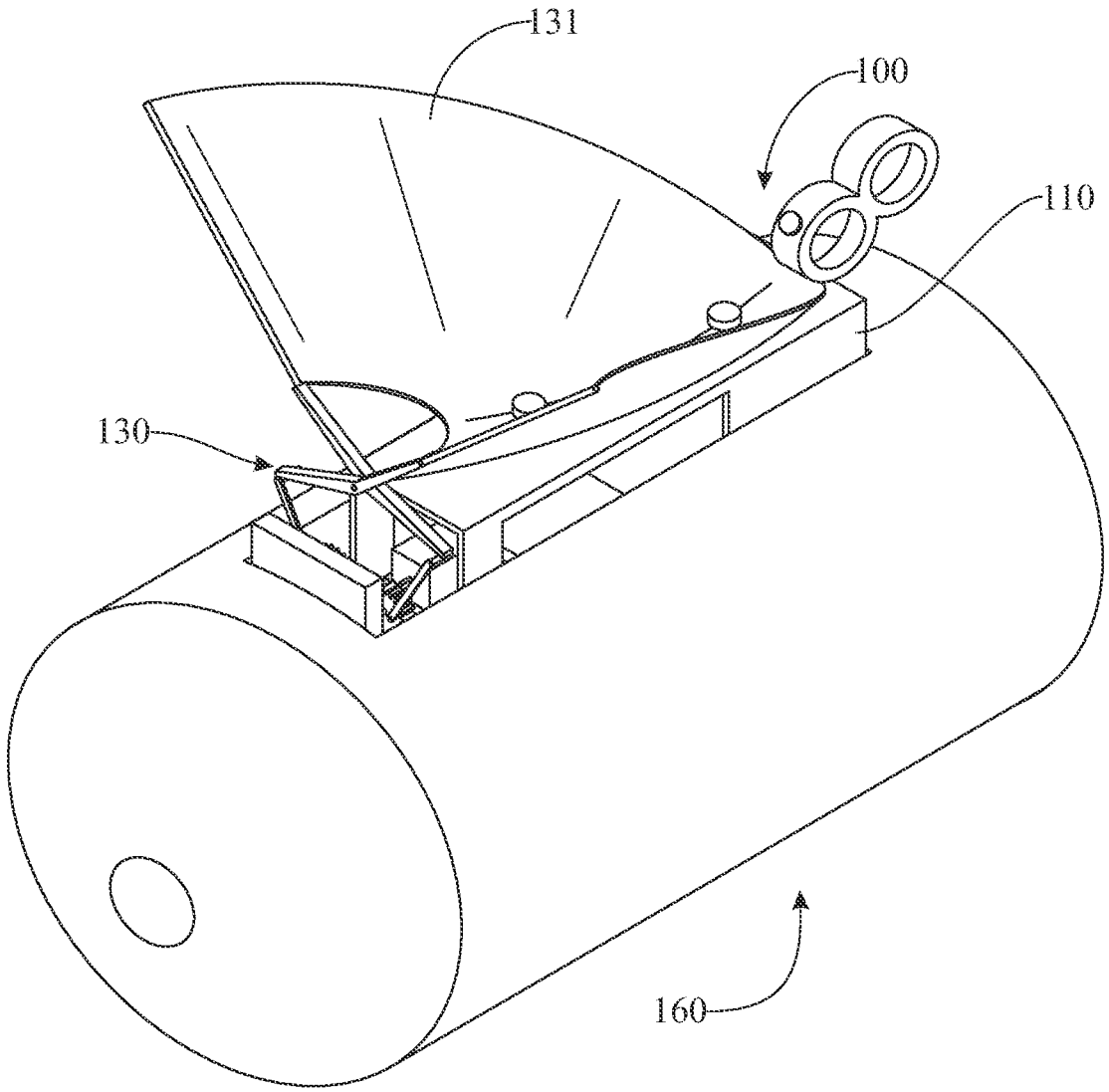
FIG. 9 illustrates a side perspective view of the toy with the winged device coupled thereto, in accordance with one embodiment of the present invention.

FIG. 9 illustrates a perspective view of the toy 160 with the winged device 100 inserted into the receiving chamber 162 of the toy 160. The winged device 100 is securely held within the chamber 162 since the magnetic strips 164 of the toy 160 engage with the coupling means 120 of the winged device 100. Further, the winged device 100 may be decoupled from the toy 160 and inserted into a chamber of another toy. For instance, a user may apply a pulling force to overcome the magnetic attraction force between the magnetic strips 164 and the coupling means 120, thereby pulling the winged device 100 out of the chamber 162 of the toy 160.

Figure 10:
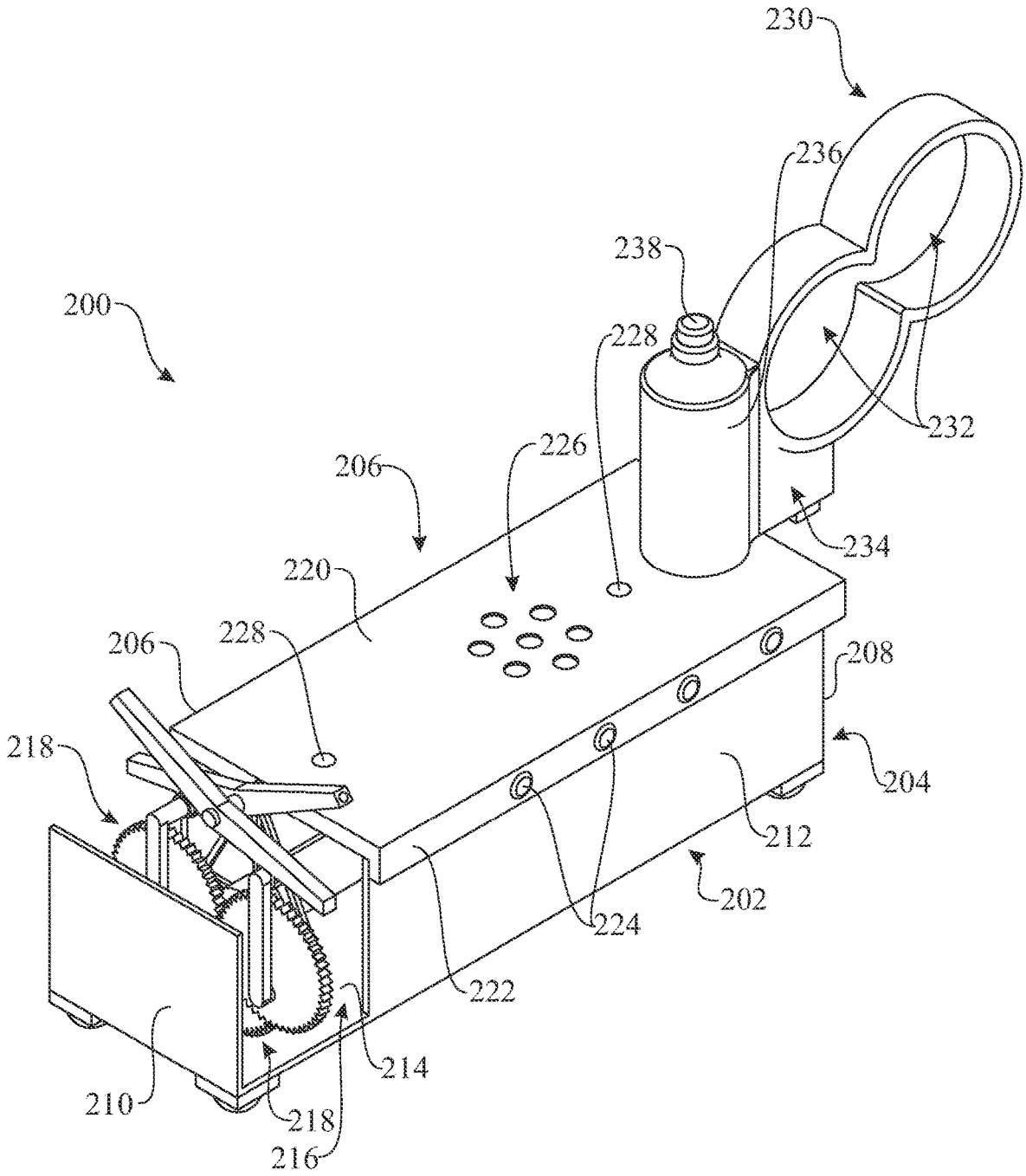
FIG. 10 illustrates a side perspective view of a winged device, in accordance with second exemplary embodiment of the present invention.
Figure 11:
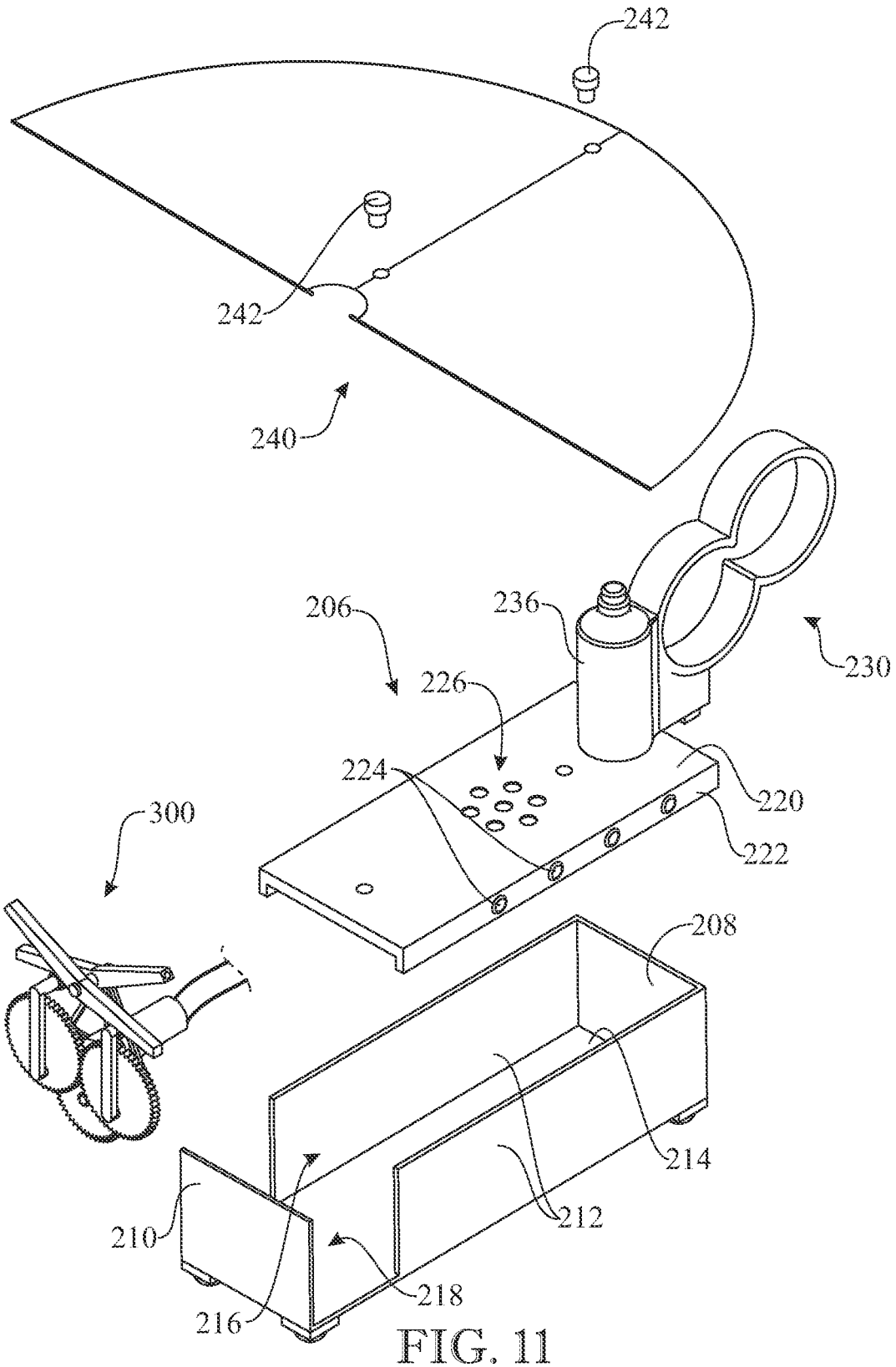
FIG. 11 illustrates an exploded side perspective view of the winged device as seen in FIG. 10, in accordance with one embodiment of the present invention.

With reference now to FIGS. 10 through 13, a secondary embodiment of device 100 is generally shown as device 200. The device 100, as seen in FIG. 1, and the device 200, as seen in FIG. 10, are similar and have like components. The device 200 generally comprises a housing 202, a mechanical component 300, wings 350 that are attachable to the mechanical component 300, electronic components 302, and one or more handle components 400. The housing 202 comprises a top-end 206 and a bottom-end 204. The bottom end 204 of housing 202 includes a rear end wall 208, a front end wall 210, and a pair of sidewalls 212 that extend upwardly from a bottom wall surface 214 and are put together to provide an internal space 216. The sidewalls 212 of the main housing 202 may include in one exemplary embodiment openings that allow the mechanical components 300 of the instant device to move unencumbered. The top end 206 of the main housing 202 comprises a top surface 220 with protruding sides 222 extending downwardly from the wall surface 220. The top end 206 of the main housing 202 also includes a number of LEDs 224 disposed of on sides 222, a plurality of speaker holes 226, and one or more openings for the wing pegs 228. Attached to the top end 206 of the main housing 202 is a first handle device 230. The handle device 230 in one exemplary embodiment includes one or more finger holes 232 configured and adapted to receive one or more fingers. At a distal end 234 of the first handle device 230 is a post 236 with an action button 238 that activates the mechanical components 300. The device 200 also includes a set of wings that are removably attached to the main housing 202 through fasteners 242, such as pegs insertable into holes 228, are removably attachable to the mechanical components 300, as described above and seen in FIG. 6.

Figure 12:
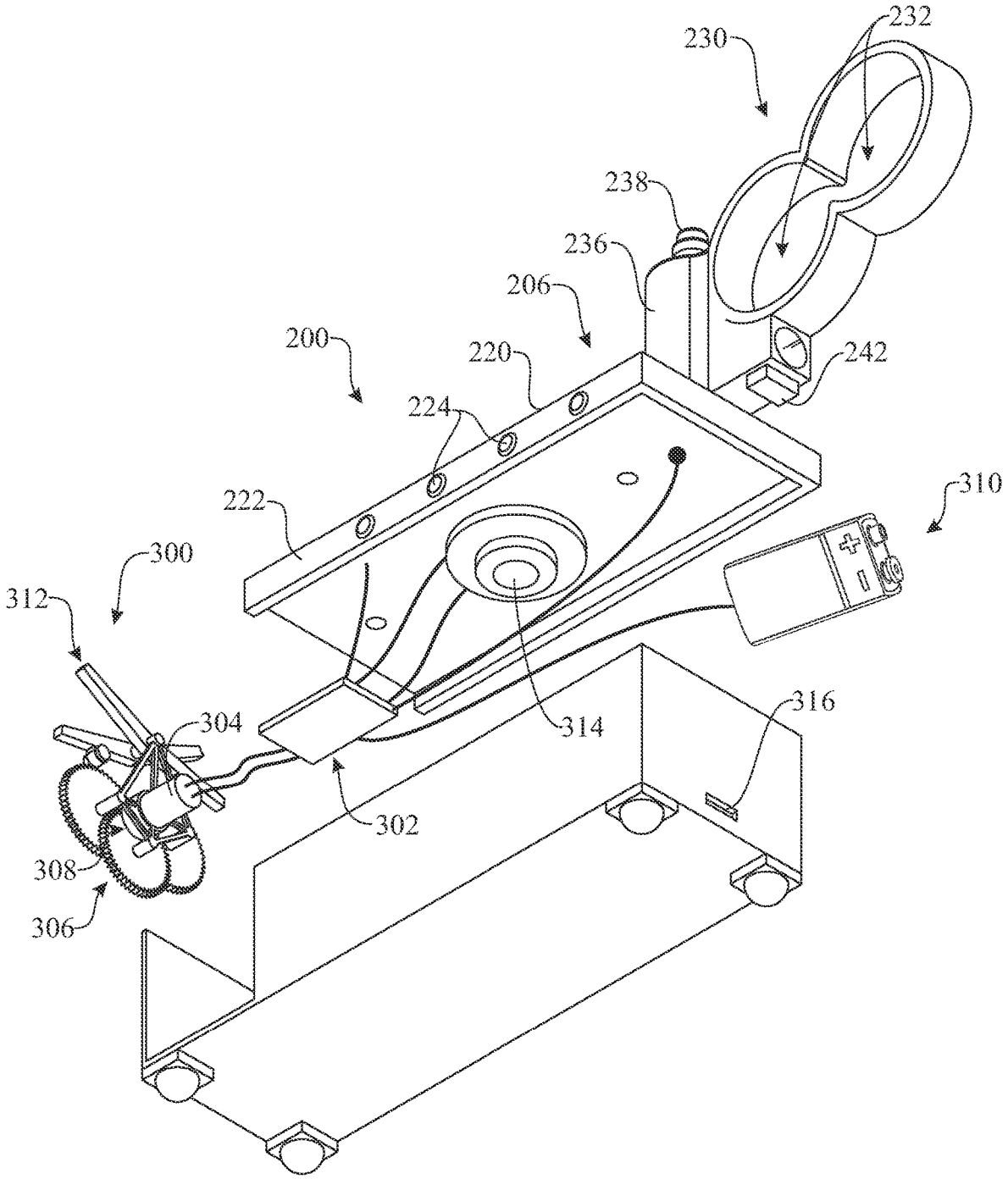
FIG. 12 illustrates an exploded bottom perspective view of the winged device as seen in FIG. 10, in accordance with one exemplary embodiment of the present invention.

With reference now to FIGS. 10 and 12, the device 200 includes a mechanical component 300 driven by a motor 304 that connects to a processor 302 and is powered by a power source 310. The power source 310 in one exemplary embodiment, may comprise a rechargeable lithium-ion battery that is charged through a charging port 316. Alternative power sources include non-rechargeable batteries. The processor 302 is also connected to a sound emitting device 314, such as a speaker, and the LEDS 224 disposed of on the top end 206 of the main housing 202. The term processor, as used herein, refers to central processing units, microprocessors, microcontrollers, reduced instruction set circuits (RISC), application specific integrated circuits (ASIC), logic circuits, and any other circuit or processor capable of executing the functions described herein. As used herein, the terms "software' and "firmware" are interchangeable, and include any computer program stored in memory for execution by the processor, including RAM memory, ROM memory, EPROM memory, EEPROM memory, and nonvolatile RAM (NVRAM) memory. The above memory types are exemplary only, and are thus not limiting as to the types of memory usable for storage of a computer program.

The processor 302 of the instant invention is configured to run one or more executable commands that run the motor 304, the LEDs 224, and the sound emitting device 314. In one exemplary form, the action button 238 of the first handle device 230, when depressed, activates motor 304. The motor 304 is linked to a drive shaft 308 that drives one or more gears 306 connected to one another. In one exemplary form, the drive shaft 308 drives a first driving gear, and that first gear drives a second and/or third gear. The gear movements, in turn, move the wing frames 312 that is removably attached to the device's wings 240 (see further explanation above and FIG. 4-6). One will appreciate that a second drive shaft may be coupled to the drive motor with the second drive shaft coupled to another driving gear that drives additional gears. In this exemplary embodiment, the number of wings attached to the device 200 can be increased from a first set of wings to at least two sets of wings. The processor 302 of the device 200 is also programmable to control the function of the sound emitting device 314 and the LEDs. In one exemplary form, device 200 includes an action button 242 disposed on the first handle device 230. Depressing button 242 can either turn ON/OFF the LEDs, which are configured to emit light in one or more light show variations. The sound emitting device 314, which is attached to the top end 206 of the main housing 202 where the speaker holes 226 are located, is designed and configured to emit varied sounds. The speaker 314, in one exemplary embodiment, may wirelessly connect to another electronic device, e.g., a smartphone, tablet, computer, or the like, and play music transmitted by the electronic device to the speaker while a user handles the device 200.

Figure 13:
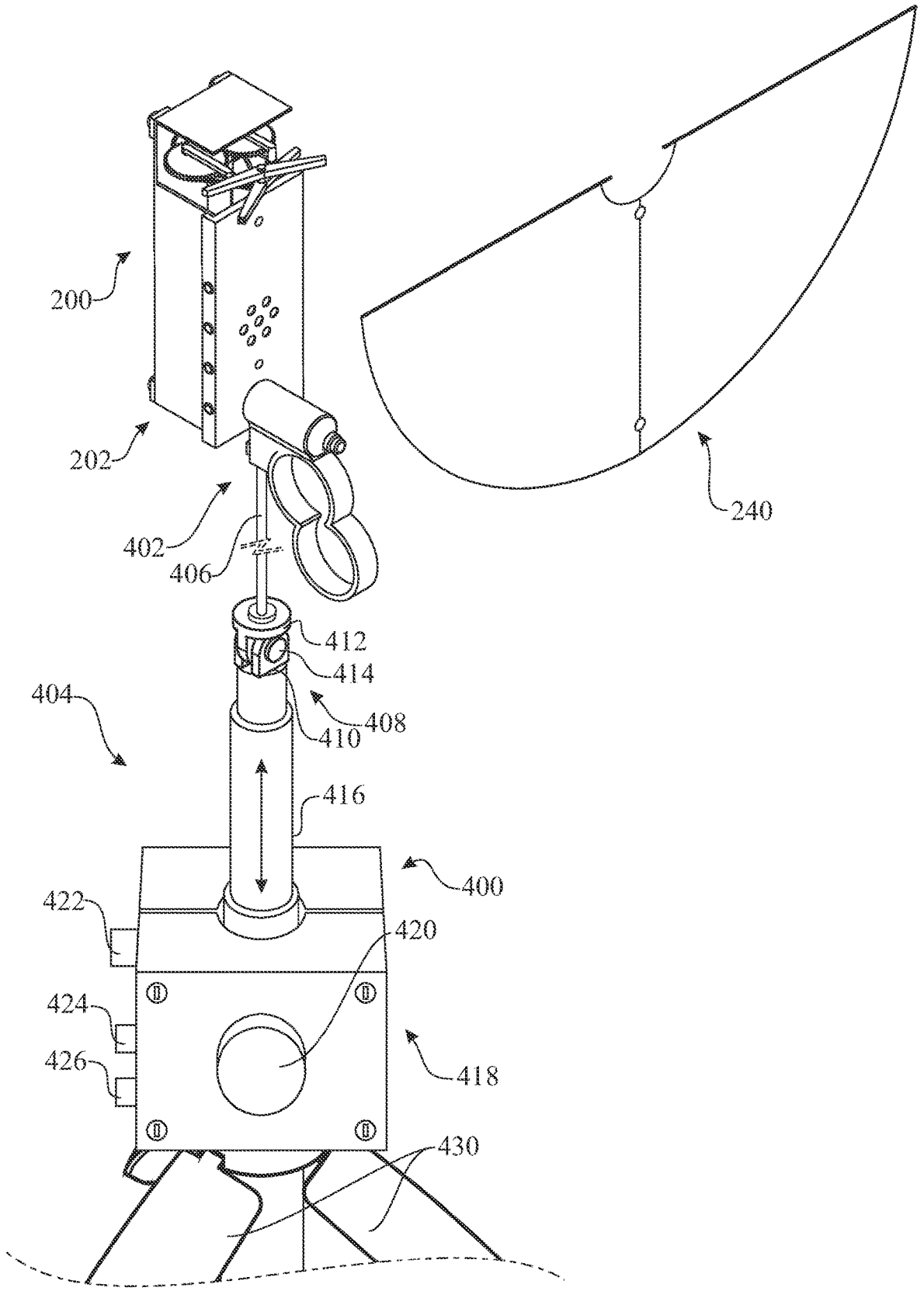
FIG. 13. Illustrates a side perspective view of the winged device attached to a handle device, in accordance with one exemplary embodiment of the present invention.

Turning now to FIGS. 10, 12, and 13, the device 200 a secondary handle device 400 may be removably coupled to the device 200. In one exemplary form, the secondary handle device 400 includes an upper attachment portion 402 that is removably attachable to the device 200, and a lower base portion 404 that includes one or more components. The upper portion 402 of the secondary handle device 400 includes a stem 406 with an attachment head at a distal end that is removably attachable to the housing 202 of device 200. The proximal end of stem 406 is attached to a movable head 408. The movable head 408 includes a rotating platform 410 for rotational movement and a pivoting member 412 about a pivot 414 for pivotal movement, Coupled to the rotational platform 410, the handle device 400 includes an extendable arm 416. In one exemplary embodiment, the extendable arm 416 is a telescopic arm. As seen in FIG. 13, the telescopic arm 416 is retractable and extendable from a control box 418. The control box 418 is wirelessly or wired to the processor 302 of the device 200. The control box 418 in one exemplary form includes a first action button 420, an action button/dial 422, a third action button 424, and a fourth action button 426. Provided below a bottom end of the control box are a number of movable stabilizing platform legs 430 that is configured to be moved from an open position, which stabilizes the device 200 in an upright position when attached to the handle device 400, and a closed position.

The action buttons of the control box 418 are configured to trigger the performance of one or more actions. For instance, the first action button 420 on the control box 418, when depressed activates/deactivates the flapping of the device's wings 240. In other words, the button engages the motor 304 that drives the gear assembly 306 that move the wing frames 312 that are attached to the wings 240. The second action dial 422 of the control box 418 in one exemplary form can control the speed of the wing flaps by varying the output of the motor 304 driving the gear assembly 306. Action button 424 can control the sound emitting device 314 of device 200, and the fourth action button 426 can control activation/deactivation of the LEDs 224. When the handle device 400 is attached to the device 200, the primary controls are switched from the action buttons disposed on the device 200 itself to the action buttons on the handle device 400. Conversely, when the handle device 400 is not attached to device 200, the action buttons on the device itself govern (e.g., action buttons 242, 238 shown in FIG. 12).

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A device configured to be detachably coupled to a toy, comprising:

a housing that includes a plurality of upstanding walls defining an internal space;

a wing assembly that includes at least one wing configured to move in a flapping motion;

a flapping mechanism disposed of within the internal space of the housing with at least one component attached to a portion of the wing assembly, the flapping mechanism configured to cause the flapping motion of the wing assembly;

a first handle device for holding the device, wherein the first handle device comprises a proximal portion and a distal portion, the proximal portion includes one or more finger openings, and the distal portion includes a post member attached to a proximal portion of the housing; and an action button for activating or deactivating movement of the flapping mechanism.

2. The device of claim 1, wherein the action button is disposed of at a top end of the post member attached to the proximal portion of the housing.

3. The device of claim 1, wherein the housing comprises a bottom portion and a removable top portion.

4. The device of claim 3, wherein the bottom portion includes a rear end wall, a front end wall, sidewalls, and a bottom end that define the internal space of the housing, and wherein the housing includes a break in the sidewalls providing an open area for allowing unobstructed movement of the flapping mechanism.

5. The device of claim 3, wherein the top portion of the housing includes a top surface wall with downward projecting lateral sides that hang over the sidewalls of the housing when the top portion is coupled to the bottom portion.

6. The device of claim 1, wherein the flapping mechanism comprises:

a power source;

a motor powered by the power source;

a drive shaft coupled to the motor at a first end and configured to rotate when the motor is powered;

a drive gear coupled to the drive shaft at a second end, the drive gear configured to be driven by the drive shaft;

one or more gears driven by the drive gear; and one or more wing frames coupled to the one or more gears, wherein the wing frames oscillate in movement to cause the flapping motion of the wing assembly.

7. The device of claim 6, wherein the power source includes a rechargeable lithium-ion battery.

8. The device of claim 1, further comprising one or more electronic components that activate or deactivate when a secondary action button is depressed.

9. The device of claim 8, wherein the electronic components include a processor configured to execute one or more commands stored in memory, a sound emitting device and one or more LEDs in electronic communication with the processor.

10. The device of claim 9, wherein the sound emitting device is disposed of in the internal space of the housing, and the sound emitting device is configured to emit sounds stored in the memory of the processor or emit sounds wirelessly transmitted from an electronic device.

11. The device of claim 1, further comprising a secondary handle device removably attachable to a portion of the housing, the secondary handle device comprising:

an upper attachment portion removably attached to the housing;

a lower portion that includes at an end one or more stabilizing platform configured to maintain the device in an upright position; and a control box that includes one or more action buttons for activating the flapping mechanism.

12. The device of claim 11, wherein the secondary handle device when attached to the device overrides the action button of the first handle device to activate or deactivate the flapping mechanism.

13. The device of claim 11, wherein the lower portion includes an extendable arm with a rotational and pivoting end attached to the upper attachment portion of the secondary handle device.

14. A device configured to be detachably coupled to a toy, comprising:

a housing comprising a bottom portion and a removable top portion, the bottom portion includes a rear end wall, a front end wall, sidewalls, and a bottom end that define an internal space, the top portion of the housing includes a top surface wall with downward projecting lateral sides that hang over the sidewalls of the housing when the top portion is coupled to the bottom portion, and speaker holes;

a wing assembly that includes at least one wing configured to move in a flapping motion;

a flapping mechanism disposed of within the internal space of the housing with at least one component attached to a portion of the wing assembly, the flapping mechanism configured to cause the flapping motion of the wing assembly, wherein the housing includes a break in the sidewalls providing an open area for allowing unobstructed movement of the flapping mechanism;

a first handle device for holding the device;

one or more electronic components comprising a processor configured to execute one or more commands stored in memory, a sound emitting device and one or more LEDs in electronic communication with the processor;

a power source for powering the flapping mechanism and the electronic components; and at least action button for activating or deactivating movement of the flapping mechanism and the one or more electronic components.

15. The device of claim 14, wherein the flapping mechanism comprises:

a motor powered by the power source;

a drive shaft coupled to the motor at a first end and configured to rotate when the motor is powered;

a drive gear coupled to the drive shaft at a second end, the drive gear configured to be driven by the drive shaft;

one or more gears driven by the drive gear; and one or more wing frames coupled to the one or more gears, wherein the wing frames oscillate in movement to cause the flapping motion of the wing assembly.

16. The device of claim 14, wherein the sound emitting device is disposed of in the internal space of the housing directly below the speaker holes of the top portion of the housing.

17. The device of claim 14, wherein the sound emitting device is configured to emit sounds stored in the memory of the processor or emit sounds wirelessly transmitted from an electronic device.

18. The device of claim 14, wherein a secondary handle device with one or more action buttons configured to activate or deactivate the flapping mechanism and the electronic components is attachable to the device, and wherein attaching the secondary handle device to the device overrides the action button of the first handle device to activate or deactivate the flapping mechanism.

19. A device configured to be detachably coupled to a toy, comprising:

a housing comprising a bottom portion and a removable top portion, the bottom portion includes a rear end wall, a front end wall, sidewalls, and a bottom end that define an internal space, the top portion of the housing includes a top surface wall with downward projecting lateral sides that hang over the sidewalls of the housing when the top portion is coupled to the bottom portion, and speaker holes;

a wing assembly that includes at least one wing configured to move in a flapping motion;

a flapping mechanism disposed of within the internal space of the housing with at least one component attached to a portion of the wing assembly, comprising:

a power source;

a motor powered by the power source;

a drive shaft coupled to the motor at a first end and configured to rotate when the motor is powered;

a drive gear coupled to the drive shaft at a second end, the drive gear configured to be driven by the drive shaft;

one or more gears driven by the drive gear; and one or more wing frames coupled to the one or more gears, wherein the wing frames oscillate in movement to cause the flapping motion of the wing assembly, and wherein the housing includes a break in the sidewalls providing an open area for allowing unobstructed movement of portions of the flapping mechanism;

a first handle device for holding the device;

one or more electronic components comprising a processor configured to execute one or more commands stored in memory, a sound emitting device and one or more LEDs in electronic communication with the processor, all powered by the power source;

at least action button for activating or deactivating movement of the flapping mechanism and the one or more electronic components; and a secondary handle device removably attachable to a portion of the housing, the secondary handle device comprising:

an upper attachment portion removably attached to the housing;

a lower portion that includes at an end one or more stabilizing platform configured to maintain the device in an upright position; and a control box that includes one or more action buttons for activating the flapping mechanism, wherein the secondary handle device when attached to the device overrides the action button of the first handle device to activate or deactivate the flapping mechanism and the electronic components.

* * * * *